US006533591B1

(12) United States Patent
Lee

(10) Patent No.: US 6,533,591 B1
(45) Date of Patent: Mar. 18, 2003

(54) METHOD FOR FORMING FINE PITCH CONTACTS AND FINE PITCH CONTACTS OBTAINED THEREBY

(75) Inventor: Genn-Sheng Lee, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/027,691

(22) Filed: Dec. 19, 2001

(51) Int. Cl.[7] ..... H01R 9/09
(52) U.S. Cl. ..... 439/83; 439/856; 439/862
(58) Field of Search ..... 439/83, 81, 82, 439/66, 682, 342, 876, 857, 856, 862

(56) References Cited

U.S. PATENT DOCUMENTS 5,188,535 A * 2/1993 Bertho et al. ..... 439/83

* cited by examiner

*Primary Examiner*—P. Austin Bradley
*Assistant Examiner*—Alexander Gilman
(74) *Attorney, Agent, or Firm*—Wei Te Chung

(57) ABSTRACT

A method for forming fine pitch contacts (1) used in a ZIF socket comprises the following steps: stamping a contact strip (3) to form a plurality of contacts each comprising a first portion, a retaining portion (10) and a second portion being coplanar with each other, the first portion comprising a pair of arcuate arms (121) defining a circular receiving space (20) therebetween and a pair of parallel contacting fingers (120) defining engaging space (21) therebetween; bending the first portion to form a contacting portion (12) perpendicular to the retaining portion and the second portion; bending the second portion to form a soldering portion (11) perpendicular to the retaining portion and parallel to the contacting portion.

6 Claims, 3 Drawing Sheets

METHOD FOR FORMING FINE PITCH CONTACTS AND FINE PITCH CONTACTS OBTAINED THEREBY

BACKGROUND OF THE INVENTION

1. Field of the Invention

The present invention relates to a method for forming fine pitch contacts and fine pitch contacts obtained thereby. Particularly, the present invention relates to a method for forming fine pitch contacts used in a Zero Insertion Force (ZIF) socket and fine pitch contacts used in a ZIF socket.

2. Description of Prior Art

As shown in FIGS. 4 and 5, a conventional contact 9 used in a ZIF socket is illustrated. The conventional contact 9 comprises a soldering portion 93 configured as a round plate for being surface-mounted on a printed circuit board through a solder ball attached thereon, a retaining portion 92 extending vertically with respect to the soldering portion 93 and connected thereto through a connecting tab 95, and a contacting portion 91 for electrically engaging with a pin of a Central Processing Unit (CPU) mounted on the ZIF socket for establishing an electrical connection between the CPU and the printed circuit board. The contacting portion 91 has a neck portion 914 connecting with the retaining portion 92 and a pair of resilient arms 910 projecting oppositely from the neck portion 914 and between which a circular receiving space 913 is defined for receiving the pin of the CPU. The pair of resilient arms 910 have a pair of cantilever contacting fingers 912 defining an engaging gap 911 therebetween.

The conventional contact 9 as described above is formed by the following steps:

a. providing a contact strip with a plurality of contacts stamped thereon (only one stamped contact 9' shown in FIG. 5);

b. curving the horizontal portions 91' of the stamped contact 9' to form the resilient arms 910 defining a circular receiving space 913 therebetween and the contacting fingers 912 confronting each other;

c. bending the round portion 93' of the stamped contact 9' to be vertical to the joint portion 92' to respectively form the soldering portion 93 and the retaining portion 92 of the final contact 9; and d. inserting the plurality of stamped contacts 9' in a housing of the ZIF socket and cutting the plurality of stamped contacts 9' from the contact strip to obtain the final contacts 9.

To maintain a fine pitch (which is 1.27 mm as well known in the art) between two adjacent contacts in the ZIF socket, the width "A" of the expanded contacting portion 91' stamped on the contact strip should at least double the pitch, that is, at least 2.54 mm. Thus, a problem of the above method for forming the conventional contact is that the expanded contact 9' shown in FIG. 5 wastes a great deal of material.

Furthermore, residual stress is accumulated in the contacting portion 91 when curving the resilient arms 910 of the contacting portion 91 by a bending device.Once the contacting portions 91 of the contacts 9 are removed from the bending device, the pairs of resilient arms 910 will deviate from their intended positions due to stress relaxation. When this happens, the contacting portions 91 of the contacts 9 are unable to accurately mate with the pins of the CPU, thereby adversely affecting a proper engagement between the CPU and the printed circuit board.

Hence, an improved method for forming a contact used in a ZIF socket is required to overcome the above-mentioned disadvantages of the prior art.

BRIEF SUMMARY OF THE INVENTION

A first object of the present invention is to provide a method for forming fine pitch contacts used in a ZIF socket and fine pitch contacts obtained thereby, whereby the space occupied by contacts stamped on a contact strip can be greatly decreased to thus reduce the manufacturing cost of the contacts.

A second object of the present invention is to provide a method for forming fine pitch contacts used in a ZIF socket and fine pitch contacts obtained thereby, whereby the deviation problem of contacting portions of the contacts from their intended positions due to stress relaxation can be effectively solved.

To fulfill the above-mentioned objects, a method for forming fine pitch contacts used in a ZIF socket in accordance with the present invention comprises the following steps:

a. stamping a contact strip comprising a carrier strip and a plurality of contacts, each contact comprising a first portion opposite the carrier strip, a retaining portion extending from the first portion to the carrier strip, and a second portion projecting from the retaining portion and connecting with the carrier strip, the first portion, the retaining portion and the second portion being coplanar with each other, the first portion comprising a pair of arcuate arms defining a circular receiving space therebetween and a pair of parallel contacting fingers extending from respective distal ends of the pair of arcuate arms;

b. bending the first portions of the contacts to form contacting portions perpendicular to the retaining portions and the second portions;

c. bending the second portions of the contacts to form soldering portions perpendicular to the retaining portions and parallel to the contacting portions; and d. inserting the plurality of contacts in a housing of the ZIF socket and cutting them from the carrier strip.

Other objects, advantages and novel features of the invention will become more apparent from the following detailed description of the present embodiment when taken in conjunction with the accompanying drawings.

DETAILED DESCRIPTION OF THE INVENTION

Figure 1:
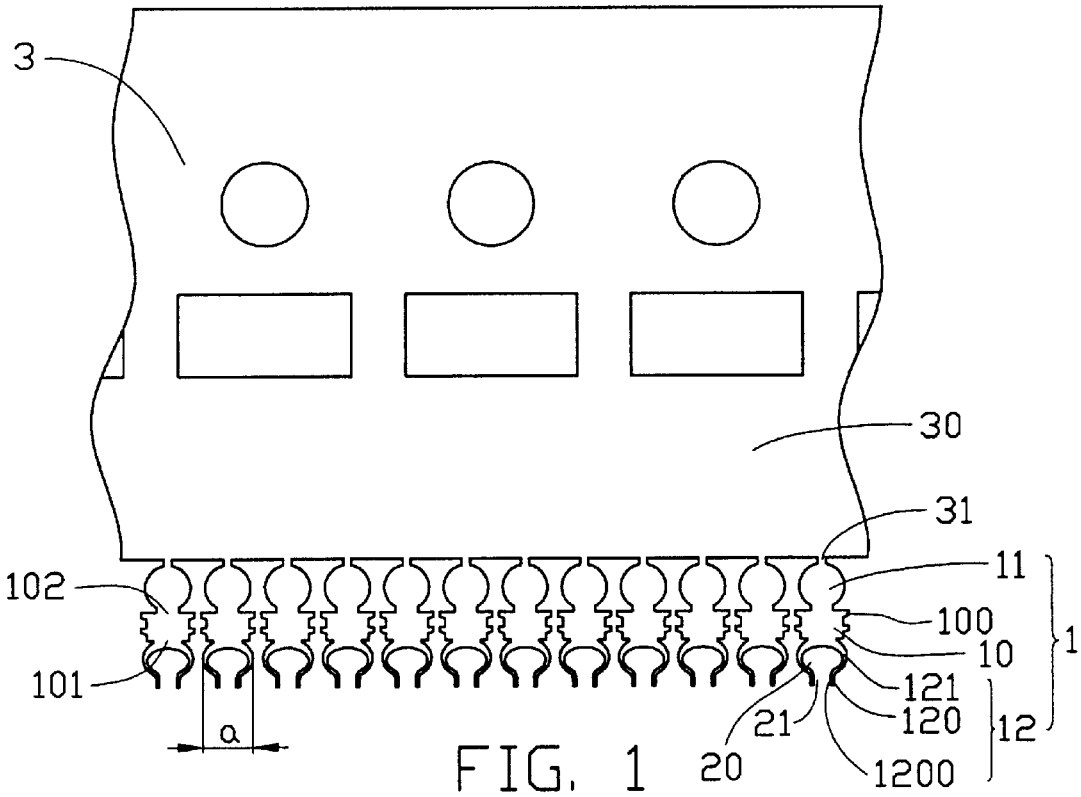
FIG. 1 is a top plan view of a contact strip having a plurality of contacts stamped thereon in accordance with a first embodiment of the present invention.
Figure 2:
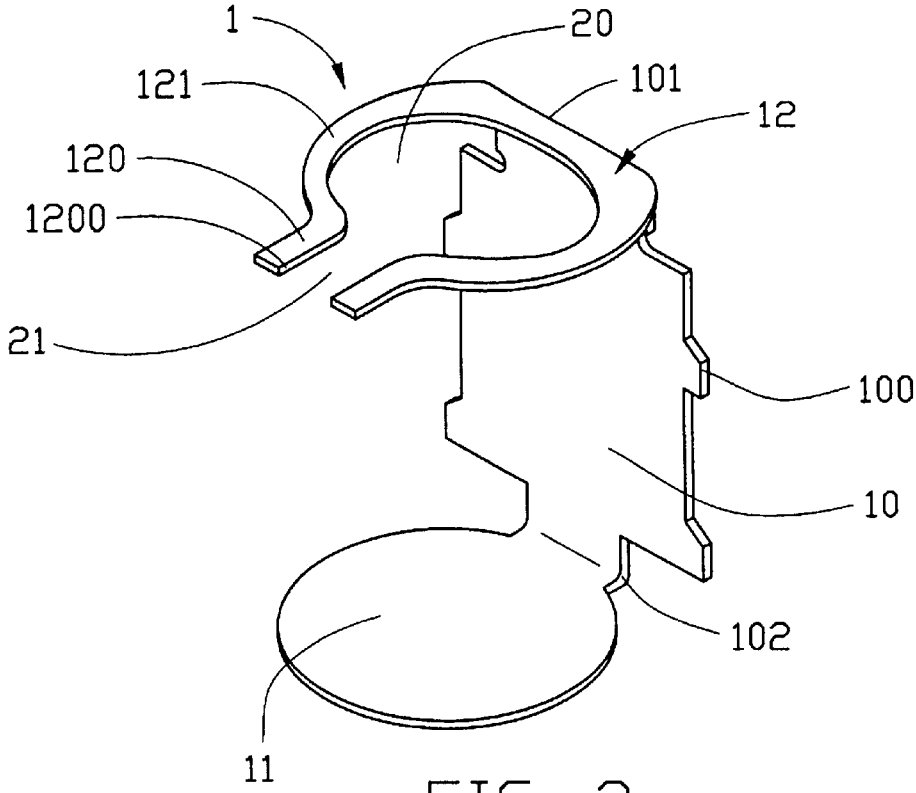
FIG. 2 is a perspective view of a contact used in a ZIF socket in accordance with a first embodiment of the present invention.

Referring to FIGS. 1 and 2, in order to obtain a contact 1 used in a ZIF socket (not shown) in accordance with a first embodiment of the present invention, a contact strip 3 is first stamped from a metal sheet to comprise a carrier strip 30 and a plurality of contacts 1. The contacts 1 connect to the carrier strip 30 through a link 31, one end of which connects with the carrier strip 30 and the other end of which connects with a soldering portion 11 of the contact 1. A substantially rectangular retaining portion 10 of the contact 1 extends from the soldering portion 11 opposite to the carrier strip 30. A plurality of barbs 100 are formed on opposite lateral edges of the retaining portion 10 for interference with corresponding contact receiving holes of the ZIF socket. The soldering portion 11 is formed as a circular plate for SMT purpose.

The contact strip 3 further comprises a contacting portion 12 for each contact 1. The contacting portion 12 extends from the retaining portion 10 and is coplanar with the retaining portion 10 and the soldering portion 11. The contacting portion 12 has a pair of arcuate arms 121 extending from the retaining portion 10, between which an approximate circular receiving space 20 is defined for correspondingly receiving a pin of a CPU (not shown) which engages with the ZIF socket. A pair of parallel contacting fingers 120 project from respective distal ends of the pair of arcuate arms 121 and extend a predeterminate distance. Between the pair of contacting fingers 120, an engaging space 21 is defined communicating with the circular receiving space 20. The pair of contacting fingers 120 comprise a pair of respective contacting faces 1200 on inner surfaces thereof confronting each other for electrical connection with the pin of the CPU. The highness of the contacting face 1200 is substantially equal to the thickness of the metal sheet.

The contact strip 3 is then subject to two bending operations successively. During the first bending operation, the contacting portion 12 is integrally bent to be perpendicular to the retaining portion 10 along an upper side 101 of the retaining portion 10. During the second bending operation, the soldering portion 11 is integrally bent to be perpendicular to the retaining portion 10 along a lower side 102 of the retaining portion 10 and parallel to the contacting portion 12. The soldering portion 11 extends in a same direction as the contacting portion 12. Finally, a cutting operation is applied to the contact strip 3 to cut the plurality of contacts 1 from the contact strip 3 after insertion the contacts 1 in a housing of the ZIF socket.

Figure 5:
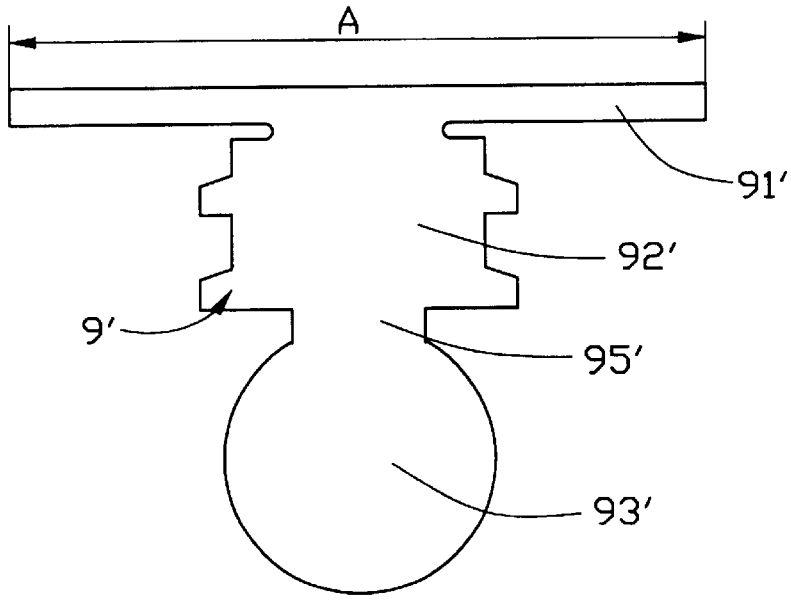
FIG. 5 (PRIOR ART)
FIG. 5 is an expanded view of the conventional contact used in a ZIF socket shown in FIG. 3.

Compared with the prior art, because the circular receiving space 20 and the engaging space 21 of the contact 1 have been defined by the pair of arms 121 and the pair of contacting fingers 120 stamped on the contact strip 3 prior to a bending operation applied thereto, the width "a" of the contacting portion 12 is necessarily and smaller than 1.27 mm (a fine pitch between two adjacent contacts as known in the art), which is distinctly smaller than the width A of the expanded, conventional contacting portion 91 shown in FIG. 5, thereby occupying little space on the contact strip 3, saving the material and decreasing the cost of forming the contact 1.

On the other hand, the arcuate arms 121 and the contacting fingers 120 are configured and directly stamped on the contact strip 3 so that the method for producing the contact 1 of the present invention is much simplifier than the conventional method which requires the resilient arms 910 and the contacting portions 912 of the conventional contacts 9 be precisely curved for assuring a substantially correct and proper engagement between the pin of the CPU and the contact. Thus, no additional device for curving the contacting portion 91 is needed by the present invention. Moreover, the residual stress accumulated in the contact 1 of the present invention is greatly reduced compared with the prior art. Additionally, the contacting highness of the contacting portion 12 of the present invention is the thickness of the metal sheet, while the contacting highness of the contacting portion 91 of the conventional contact 9 is designed and stamped from the metal sheet, which is larger than the thickness of the metal sheet.

Figure 3:
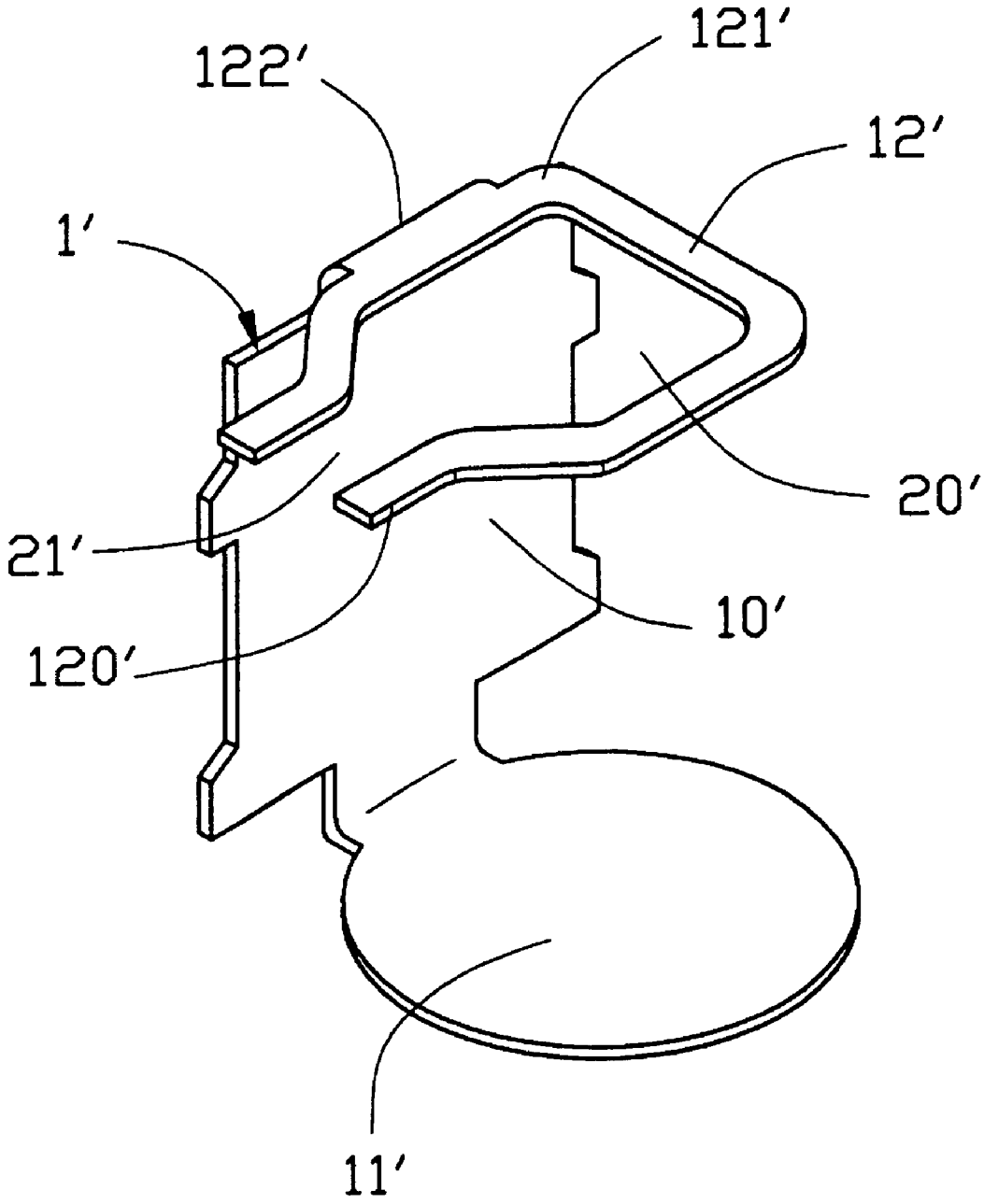
FIG. 3 is a perspective view of a contact used in a ZIF socket in accordance with a second embodiment of the present invention.
Figure 4:
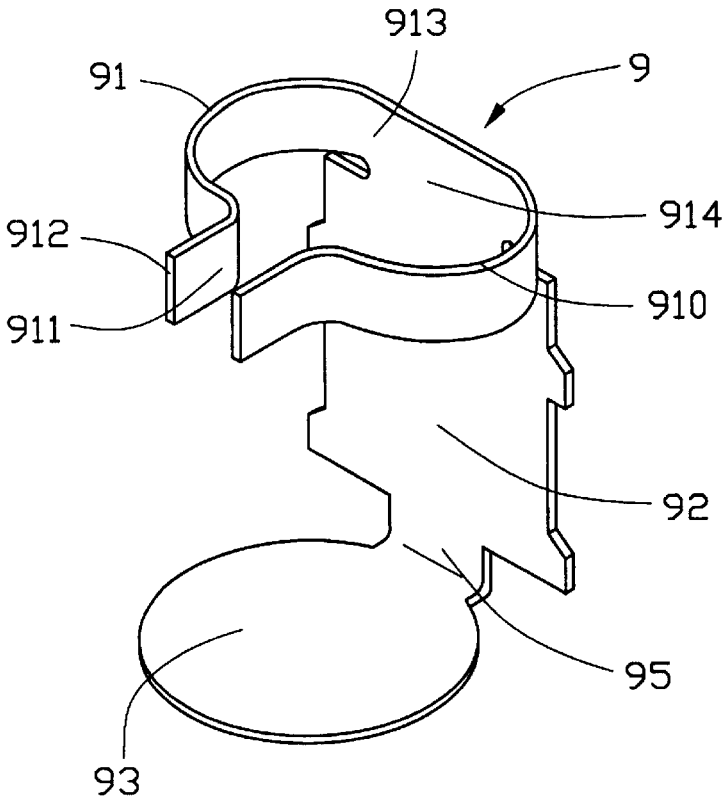
FIG. 4 (PRIOR ART)
FIG. 4 is a perspective view of a conventional contact used in a ZIF socket.

FIG. 3 illustrates a contact 1' in accordance with a second embodiment of the present invention. A contacting portion 12' of the contact 1' has a neck portion 122' connecting with a retaining portion 10', and a C-shaped portion 121' defining a circular receiving space 20' therein. A pair of parallel contacting fingers 120' project from opposites distal ends of the C-shaped portion 121' and extend parallel to the retaining portion 10', with which an engaging space 21' is defined for receiving the pin of the CPU. The contact 1' also defines a soldering portion 11' for being soldered to a printed circuit board (not shown) through a solder ball (not shown) attached thereon.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method for forming fine pitch contacts used in a ZIF socket comprising the following steps:

stamping a contact strip to form a plurality of contacts and a carrier strip interconnecting the contacts, each contact having a first portion distal from the carrier strip, said first portion comprising a pair of arcuate arms defining a circular receiving space therebetween and a pair of contacting fingers projecting from respective distal ends of said pair of arcuate arms and extending parallel to each other, said contact also comprising a retaining portion extending from said first portion to the carrier strip, and a second portion projecting from said retaining portion and connecting with the carrier strip, said first portion, said retaining portion and said second portion being coplanar with each other;

bending said first portions of the contacts to form contacting portions perpendicular to said retaining portions and said second portions; and configuring said second portions of the contacts to form soldering portions;

wherein the width of said portion stamped on the contact strip is smaller than 1.27 mm, wherein the stamping step comprises forming contacting faces on inner surfaces of said pair of contacting fingers, which are perpendicular to said retaining portion and said second portion during the stamping step, wherein a thickness of the contacting faces is equal to a thickness of the arms and the fingers.

2. The method as described in claim 1, wherein the stamping step comprises configuring said retaining portion of each contact in a rectangular shape and forming a plurality of barbs on opposite lateral edges thereof.

3. The method as described in claim 1, wherein the stamping step comprises configuring said soldering portion of each contact as a circular plate perpendicular to said retaining portion.

4. A contact used in a ZIF socket adapted for electrical connection a pin of a CPU with a printed circuit board, comprising:

a retaining portion having a plurality of barbs on opposite lateral edges thereof;

a soldering portion projecting from and extending perpendicular to a lower side of said retaining portion for soldering to the printed circuit board; and a contacting portion projecting from and extending perpendicular to said retaining portion, said contacting portion having a pair of arcuate arms with a circular receiving space being defined therebetween, each arcuate arm defining a contacting finger at a distal end with a contacting face being defined in an inner surface thereof for electrical connection with the pin of the CPU, wherein said contacting face is obtained from a metal sheet by a stamping step and a height of said contacting face is along a thickness of the metal sheet, wherein the width of said contacting portion is smaller than 1.27 mm, wherein said contacting portion comprises a pair of contacting fingers extend parallel to each other from respective distal ends of said pair of arcuate arms and between the contacting fingers an engaging space is defined in communication with said circular receiving space, said fingers having a thickness equal to a thickness of the contacting face.

5. The contact as described in claim 4, wherein said contacting portion is bent along an upper side edge of said retaining portion after being directly stamped from the metal sheet together with said soldering portion and said retaining portion, which are coplanar with each other during stamping operation.

6. A contact for use with a pin type complementary contact, comprising:

a vertical retaining portion with barbs thereon;

a soldering portion horizontally extending from a bottom end of said retaining portion;

a contacting portion horizontally extending from an upper end of said retaining portion, said contacting portion defining a pair of arcuate arms with a pair of contacting fingers at free ends thereof, respectively, said pair of arcuate arms defining a larger space therebetween for allowing said pin type complementary contact to freely extend downwardly while said pair of contacting fingers defining a smaller space therebetween for tightly sandwiching said pin type complementary contact therebetween after said pin type complementary contact moves horizontally away from said retaining portion and enters said smaller space; wherein said contact is stamped from a metal sheet, and said contacting portion on said metal sheet defines a lateral dimension similar to said retaining portion so that a fine pitch arrangement of a plurality. of contacts on the metal sheet can be obtained; wherein a thickness of said contacting portion is equal to that of the metal sheet, wherein for each stamped contact, said contacting portion is originally coplanary located above the retaining portion and successively downwardly bent with a right angle to be perpendicular to said retaining portion.

* * * * *